US006527065B1

(12) United States Patent
Tibbitts et al.

(10) Patent No.: US 6,527,065 B1
(45) Date of Patent: Mar. 4, 2003

(54) SUPERABRASIVE CUTTING ELEMENTS FOR ROTARY DRAG BITS CONFIGURED FOR SCOOPING A FORMATION

(75) Inventors: Gordon A. Tibbitts, Salt Lake City, UT (US); Craig H. Cooley, South Ogden, UT (US)

(73) Assignee: Baker Hughes Incorporated, Houston, TX (US)

( * ) Notice: Subject to any disclaimer, the term of this patent is extended or adjusted under 35 U.S.C. 154(b) by 13 days.

(21) Appl. No.: 09/650,799

(22) Filed: Aug. 30, 2000

(51) Int. Cl.[7] ..... E21B 10/08

(52) U.S. Cl. ..... 175/339; 175/426; 175/429; 175/430

(58) Field of Search ..... 175/426, 427, 175/428, 429, 430, 431, 331, 332, 339, 403, 415

(56) References Cited

U.S. PATENT DOCUMENTS

| | | | | |
|---|---|---|---|---|
| 192,463 A | | 6/1877 | Shaw | |
| 302,292 A | | 7/1884 | Soderstrom | |
| 1,388,490 A | | 8/1921 | Suman | |
| 2,217,889 A | | 10/1940 | Carpenter et al. | |
| 2,264,617 A | | 12/1941 | Carpenter et al. | |
| 2,371,698 A | | 3/1945 | MacFarlane | |
| 4,150,728 A | * | 4/1979 | Garner et al. | 175/374 |
| 4,554,986 A | | 11/1985 | Jones | |
| 4,660,659 A | | 4/1987 | Short Jr. et al. | |
| 4,872,520 A | | 10/1989 | Nelson | |
| 4,883,132 A | | 11/1989 | Tibbitts | |
| 5,061,293 A | | 10/1991 | Barr et al. | |
| 5,131,478 A | | 7/1992 | Brett et al. | |
| 5,199,511 A | | 4/1993 | Tibbitts et al. | |
| 5,316,095 A | | 5/1994 | Tibbitts | |
| 5,957,227 A | | 9/1999 | Besson et al. | |
| 6,290,008 B1 | * | 9/2001 | Portwood et al. | 175/426 |

FOREIGN PATENT DOCUMENTS

GB 2086451 A * 5/1982

OTHER PUBLICATIONS

International Search Report dated Aug. 23, 2002.

* cited by examiner

*Primary Examiner*—David Bagnell
*Assistant Examiner*—Jennifer R. Dougherty
(74) *Attorney, Agent, or Firm*—TraskBritt

(57) ABSTRACT

Cutting elements for use in a rotary drill bit are configured to facilitate positioning of the cutting elements at a positive rake angle with respect to the formation to enhance compressive stresses in the cutting element and to reduce cutting loads on the cutting elements. The cutting element generally comprises a three-dimensional superabrasive cutting member having a leading edge and a three-dimensional arcuate scoop-like surface which conveys formation cuttings away from the cutting element. The cutting element may also be formed to a substrate or backing. A drill bit suitable for use of the cutting elements of the invention is disclosed which includes passageways and internal fluid passages for enhancing the conveyance of formation cuttings away from the leading edge of the cutting element. A method of drilling earthen formations with a drill bit incorporating at least one cutting element comprising a three-dimensional superabrasive cutting member having a leading edge and a three-dimensional arcuate scoop-like surface which conveys formation cuttings away from the cutting element is also disclosed.

36 Claims, 10 Drawing Sheets

SUPERABRASIVE CUTTING ELEMENTS FOR ROTARY DRAG BITS CONFIGURED FOR SCOOPING A FORMATION

BACKGROUND

1. Field of the Invention

This invention relates generally to superabrasive cutting elements used in rotary drill bits, also referred to as drag bits, for use in drilling subterranean formations. More specifically, the present invention pertains to superabrasive cutting elements securable to rotary drill bits in a manner which minimizes unwanted stresses in the superabrasive member, particularly when the superabrasive cutting element is positioned at a high positive rake angle.

2. Background of the Invention

Superabrasive material such as polycrystalline diamond compact (PDC) and cubic boron nitride are commonly used in the fabrication of cutting elements employed in drill bits, particularly drill bits which are relied upon by the oil and gas industry for drilling wells in formations of earth in the exploration and production of oil and gas. Such superabrasive material may be formed into the bit body as a self-supporting member or may be employed in cutting elements which comprise a table or layer of superabrasive material joined to a substrate, or backing, of the cutting element. Typically, such cutting elements, such as representative PDC cutting element 214 depicted in cross-section in FIG. 2A, comprise a substantially planar superabrasive, or polycrystalline diamond table, such as table 216, which is disposed on an underlying supportive substrate, or backing, 218 of a suitably strong material such as tungsten carbide (WC) or carbides mixed with other metals in which the diamond table is sintered or bonded to the substrate by methods known within the art. Superabrasive diamond table 216 typically will have a planar, generally circular cutting surface 226, as can be seen in FIG. 2B which is a top view of cutting element 214. As can be seen in FIGS. 2A and 2B, cutting element 214 is provided with a cutting surface 226 which is generally planar or flat in that it extends in only two directions or dimensions, and wherein the cutting surface itself does not extend in a third direction or dimension so as to provide cutting surface 226 with a nonflat or curved cutting surface. A superabrasive cutting element of this type is commonly known as a polycrystalline diamond compact cutter or PDC cutter.

A conventional cutting element, such as a PDC cutter, is positioned in the body of the drill bit so that the superabrasive material contacts and engages subterranean formations for cutting the formation as the drill bit is rotated by the drill string, or alternately a downhole motor in which it is connected. Several factors can contribute to how efficient or inefficient the cutting element performs. Traditionally, cutting elements such as PDC cutters are positioned on the bit body of a drill bit to have either a positive rake angle, zero rake angle, or a negative rake angle with respect to the formation to be engaged by the cutter as the bit rotates and proceeds into the formation being drilled. This terminology of positive, zero, and negative rake angles as used within the art in describing the rake angle of a given cutter is illustrated in FIG. 1. Representative PDC cutters 200, 208, and 214 are all generally cylindrical in configuration and are each provided with respective superabrasive or diamond tables 202, 210, and 216 mounted on respective substrates 204, 212, and 218. Each of the cutters are designed and positioned to laterally engage the formation in the direction of arrow 206.

Cutter 200 is regarded as having a positive rake angle due to cutting surface 222 of superabrasive table 202 thereof being inclined at an angle exceeding 90° with respect to formation 220 as illustrated. Thus, as the angle becomes more obtuse, or approaches 180°, it is regarded as being more "positive". Cutter 208 is regarded as having 0° rake angle due to cutting surface 224 of superabrasive table 210 being generally perpendicular to formation 220. Lastly, cutter 214 is regarded as having a negative rake angle due to cutting surface 226 of superabrasive table 216 being inclined less than 90° with respect to formation 220 as illustrated. Thus, as the angle becomes more acute, or approaches 0°, it is regarded as being more "negative".

The characteristics of the formation being cut further influence the choice of cutting element design and placement on the body of the drill bit. For example, a PDC cutter is subjected to significant tangential loading as the drill bit rotates. Additionally, it is known that positioning the cutting element with a negative rake angle places the formation in compression. Contrastingly, positioning the cutting element with a positive rake angle results in the formation being placed in tension as the formation is engaged and cuttings or chips are sheared therefrom.

Further, it is known that conventional PDC cutter performance can be compromised by residual stresses which are induced within the cutting element itself and particularly in the area of the interface, designated as 228 in FIG. 2A, where the planar diamond table is joined with the substrate. That is, while the superabrasive diamond table is generally in compression and the substrate in tension, conventional PDC's display an undesirable amount of residual stress around the interface between the diamond table and the substrate, which stress is principally caused by different coefficients of thermal expansion in the diamond and the substrate. The high loading imposed on conventional PDC cutters during drilling, in combination with the residual stress, is known to cause unwanted spalling and delamination of the diamond table from the substrate.

Attempts have been made to remedy or lessen the failure of cutting elements employing PDCs during drilling by modifying or redirecting the residual stresses in PDC cutters by way of varying the configuration of PDC cutters. Examples of such efforts to modify the stresses in PDC's by modifying the configuration of the diamond table, the substrate, or both, are disclosed in U.S. Pat. No. 5,435,403 to Tibbitts, U.S. Pat. No. 5,492,188 to Smith, et al., and U.S. Pat. No. 5,460,233 to Meany, et al. Another type of improvement in drill bit design is disclosed in U.S. Pat. No. 5,437,343 to Cooley, et al., which discloses the use of multiple chamfers at the periphery of a PDC cutting face to enhance the resistance of the cutting element to impact-induced fracture.

It is known that conventional superabrasive cutting elements can be positioned in the bit body in a manner which optimizes cutting ability under the loading conditions of a particular formation. That is, the type of rock in the formation, the rock stresses, the filtration and the bit profile may all contribute to the performance of the cutting element. It has also been recognized that the location of the cutting element on the bit body influences the capability of the cutting element to withstand certain loading stresses. For example, it has been noted that a conventional planar cutting element located on the bit flank or shoulder may typically experience greater tangential loading than a cutting element located on the bit nose or bit gage. Further, positioning the cutting element in the bit body with a back rake (usually negative back rake) enables the cutting element to better withstand loading forces imposed upon it during drilling operations and lessens failure of the cutting element.

However, while a higher effective negative back rake permits the use of conventional planar PDC cutters, such higher effective back rakes reduce the aggressiveness of the cutter. This factor can be critical in cutting elements which are located on the bit flank or shoulder where the greatest amount of cutting of the formation occurs. Thus, it would be advantageous to provide a cutting element which is configured to effectively and aggressively cut a given earthen formation while being positioned at a high positive rake angle to place the formation in tension, thereby maximizing cutting performance and cutter durability, and it would be advantageous to position the cutting element in a manner which enhances compressive loading of the cutting element and reduces tensile stresses within the superabrasive cutter during operation of the drill bit.

Further, it would be an advantage in the art to provide means for removing the material cut from the formation as the cutters are acting upon the formation. One means of removing cut material is disclosed, for example, in U.S. Pat. No. 5,199,511 to Tibbitts, et al., wherein the cutters "shear" the formation into a plenum within the drill bit and drilling fluid circulating through the drill bit flushes fluid past apertures formed in front of the cutters to remove the formation cuttings.

U.S. Pat. No. 5,957,227 to Besson et al. and jointly assigned to the assignee of the present invention, discloses a drill bit incorporating blades which have primary and secondary cutting elements, such as PDC cutters, mounted so as to have a negative rake angle. Each of the blades are provided with tunnels or channels having a small opening located intermediate the primary cutters and the secondary cutters with respect to the direction of rotation of the drill bit. Each tunnel or channel is further provided with a larger dimensioned outlet positioned behind the secondary cutters. In one embodiment, the tunnels or channels are provided with nozzles for emitting fluid within the channel to carry formation cuttings toward the channel outlet.

While it is known that flushing fluid in proximity of conventional type cutting elements typically having negative rake angles works effectively to disperse formation cuttings away from the formation as the drill bit is in operation, the art continues to seek further advantages and efficiencies which may be gained by introducing drilling fluid proximate the cutting surfaces of cutting elements which may incorporate non-conventional configurations and which may incorporate positive rake angles to more efficiently remove formation cuttings away from the cutting elements and the bit.

SUMMARY OF THE INVENTION

In accordance with the present invention, a cutting element for use in a rotary drill bit is configured to enhance the stress state of the cutting element to accept loading imposed on the cutting element during drilling by reducing tensile loading of the cutting element and enhancing compressive stresses. The cutting element, when positioned in a drill bit body, facilitates placement of the superabrasive cutting member in suitably high compression during operational loading conditions while allowing the superabrasive cutting member to be positioned at a positive rake angle, including high positive rake angles, to prevent or lessen damage to the cutting element and to lessen cutting loads. The cutting element may, most suitably, be positioned in a drill bit structured with passageways generally in alignment with the cutting element so as to further assist the cutting element to direct formation chips away from the bit body.

Cutting elements of the present invention comprise a cutting member made of a suitable superabrasive material, such as polycrystalline diamond or cubic boron nitride. The cutting member may be formed in any known manner, including employing known high-temperature, high-pressure (HTHP) techniques of constructing PDC elements. Because of the unique shape of the cutting element, however, a more suitable method of forming the cutting member may be a chemical vapor deposition (CVD) or diamond film process as described in U.S. Pat. No. 5,337,844 to Tibbitts, the disclosure of which is incorporated herein by reference.

Superabrasive cutting members embodying the present invention preferably have a leading edge positioned to contact a formation for cutting and a three-dimensional arcuate curette or scoop-like, surface positioned rearward of the leading edge to direct formation chips away from the leading edge of the cutting element. The unique configuration of the cutting member allows the cutting element to be positioned in a drill bit body at a positive rake angle including high positive rake angles to shear chips or cuttings from the surface of the formation. As such, the cutting element is beneficially positioned to enhance compressive stresses in the cutting element and to prevent or lessen unwanted stresses in the cutting element and bit.

The three-dimensional scoop-like surface, as viewed in lateral cross-section of the cutting element, directs formation chips away from the leading edge of the cutting element. The cutting elements may, most suitably, be positioned in a drill bit body which is configured with passageways through which formation chips produced by the cutting element are flushed away from the leading edge of the cutting element through the passageway and are eventually discharged from the passageway so that the formation chips can further be circulated up the annulus between the drill string and the well bore.

Cutting elements of the present invention are suitable for use in known drill bit configurations, such as the bit configuration disclosed in U.S. Pat. No. 5,199,511 to Tibbitts, et al. or the drill bit configuration disclosed in U.S. Pat. No. 4,883,132 to Tibbitts.

Cutting elements of the present invention may also be attached to a drill bit as disclosed and described herein where passageways are formed through the drill bit body and in alignment with which the cutting element is placed to direct the sheared chips toward and through the associated passageway. The bit body disclosed herein is also preferably constructed with fluid passages positioned to deliver fluid to the passageways to facilitate flushing formation chips from the passageway and away from the bit body.

A superabrasive cutting element configured in accordance with the present invention may be formed or disposed directly to the bit body during construction or formation of the drill bit. In an alternative embodiment, the cutting element may comprise superabrasive material formed to a substrate, backing or stud by, for example, an HTHP or CVD process. The substrate of the cutting element may then be secured to the bit body by known techniques, such as brazing or furnacing. The substrate of the compact may, most suitably, be made of a carbide material such as tungsten carbide or other carbide material.

Cutting elements in accordance with the present invention may be configured in a variety of ways to provide a leading edge and a three-dimensional arcuate, curette-like, or scoop-like surface which preferably partially or fully curves toward itself to create a hollow region or volumetric cavity within the cutting element in which formation chips are guided through upon the formation chips being sheared by the leading edge of the cutting element. For example, a cutting element may be configured as a truncated frustum or hollow pyramid where the small or truncated end provides a first end defining the leading edge of the cutting element. The base of the pyramid defines a second end which is spaced apart from the first end and is configured for positioning in or toward the bit body of a drill bit. A three-dimensional scoop surface extends between the first end or leading edge and the second end of the cutting element and is positioned rearward of the leading edge to direct formation chips away from the leading edge. The cutting element, in longitudinal cross-section, may have the same thickness measurement at the leading edge as measured at the second end. In the alternative, a cutting element may have a greater thickness dimension at the second end than at the first end or leading edge, thereby giving the cutting element a wedge shape in longitudinal cross-section. The leading edge of the cutting element may be substantially linear (i.e., straight-edged) or can be curved.

Cutting elements embodying the present invention may also be formed as a truncated hollow cone where the small or truncated end of the cone defines the first end or leading edge of the cutting element and the base of the truncated cone forms the second end. In some embodiments, the element may be configured as a truncated pyramid or truncated cone, or any other suitable geometry. Alternatively, the cutting element may be formed as a longitudinal section (e.g., substantially one-half of the truncated cone) of such truncated pyramid, cone or other suitable shape.

The drill bit configuration as disclosed herein may also preferably be provided with depth-of-cut limiting structures to limit the amount of formation in which the cutting elements engage and remove chips or cuttings from the earth formation. The depth-of-cut limiting structure or structures may take any suitable form, a number of examples of which are disclosed herein. Furthermore, the drill bit configuration as disclosed herein is preferably provided with internal passages in fluid communication with an internal plenum within the drill bit body. The internal passages terminate at fluid discharge ports positioned within proximity of the disclosed cutting elements. The fluid discharge ports can be positioned aft of the cutting elements and positioned within the interior of the previously mentioned passageways to introduce drilling fluid directly therein to further assist the removal of formation chips away from the leading edge of the cutting elements. Alternatively, or in combination, fluid discharge ports may be located forward of the disclosed cutting elements and thus external of the preferably provided passageways.

DETAILED DESCRIPTION OF THE ILLUSTRATED EMBODIMENTS

Figure 3:
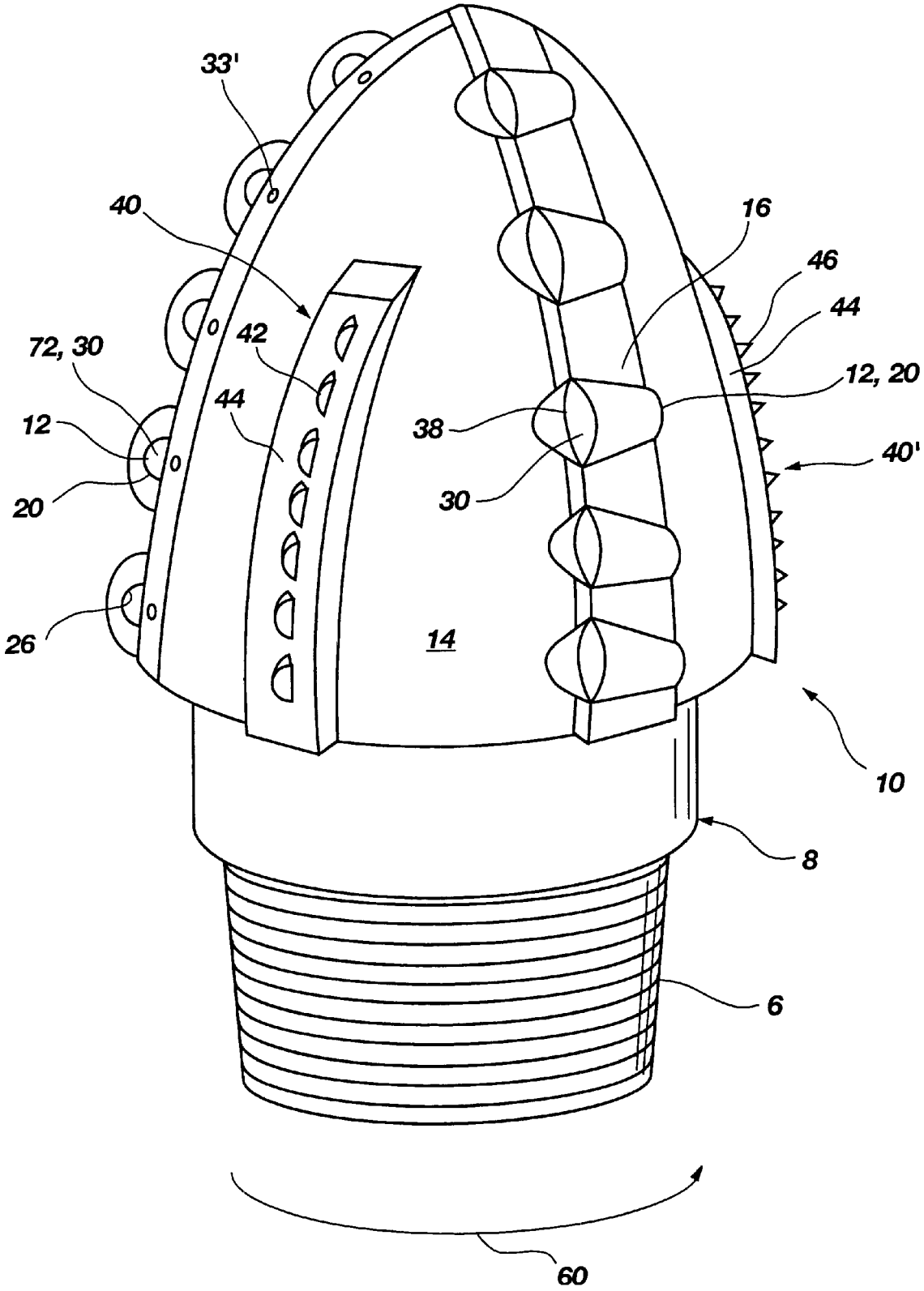
FIG. 3 is a perspective view of an exemplary drill bit incorporating cutting elements embodying the present invention.

A perspective view of a drill bit 10 embodying the present invention is depicted in FIG. 3. Bit body 10 includes a shank 8 having threaded connection portion 6 for connecting bit body 10 to a drill string or downhole motor (not shown) as customary within the art. Bit body 10 is further provided with cutting elements 12 of the present invention which are structured to be positioned about the periphery 14 and/or along the crown of bit body 10 so that cutting element 12 engages an earthen formation for cutting. More specifically, cutting elements 12 are structured to be positioned at a positive rake angle to the formation so that cutting elements 12 are beneficially placed in compression and so that cutting elements 12 advantageously exploit the tensile cutting achieved by a positive rake angle to shear the formation and reduce cutting loads on cutting elements 12 as bit body 10 is rotated while in operation in the direction shown by directional arrow 60.

Preferably, cutting elements 12 are disposed upon blades 16 which project radially outwardly from periphery 14 of bit body 10, however, such discrete blades are not required and cutting elements 12 can be disposed directly on periphery 14 of bit body 10. Cutting elements 12 can be positioned about the bit body 10 in any suitable manner or, more preferably, may be positioned in spaced arrangement along a plurality of outward projections such as blades 16, positioned about the periphery 14 of the bit body 10 which generally extend from near the crown of the bit body 10 to near the shank of the bit body 10 as is conventionally known.

Exemplary depth-of-cut (DOC) limiting structures 40 and 40' are shown extending generally longitudinally along the bit body and protrude radially outwardly therefrom a preselected distance so as to limit the depth or extent cutting elements 12 engage and remove formation material during operation of drill bit 10. Of the two DOC limiting structures depicted in FIG. 5A, structure 40 is provided with conventional cutters 42 disposed within and which may either be flush or protrude from ridge or pad 44. The other DOC limiting structure is provided with alternative antiwear elements 46 which are disposed within and may either be flush or protrude slightly from ridge or pad 44. Such exemplary DOC limiting structures will be discussed in more detail herein.

Figure 4:
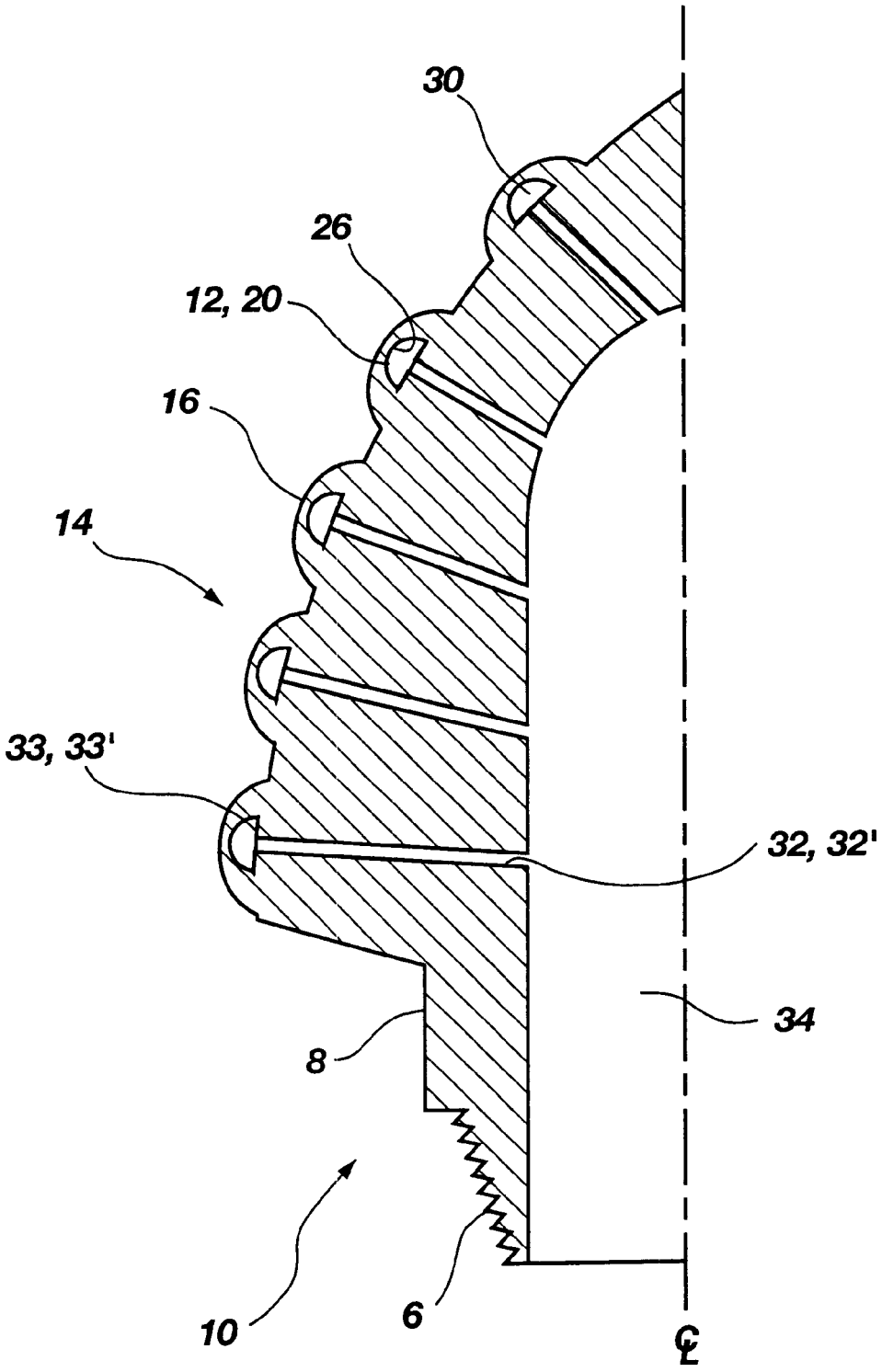
FIG. 4 is a partial longitudinal cross-sectional view of an exemplary drill bit incorporating cutting elements embodying the present invention.

Referring now to FIG. 4, a longitudinal cross-sectional view is provided of a representative portion of drill bit 10 taken along one of the blades 16 having cutting elements 12 disposed therein. Additionally shown in FIG. 4 are fluid passages 32, 32' which are in fluid communication with central plenum 34 of drill bit 10 and terminate as fluid discharge ports 33, 33' to enhance the cutting efficiency of cutting elements 12, and various alternative embodiments thereof, in accordance with the present invention which will be discussed in more detail below.

Figure 5A:
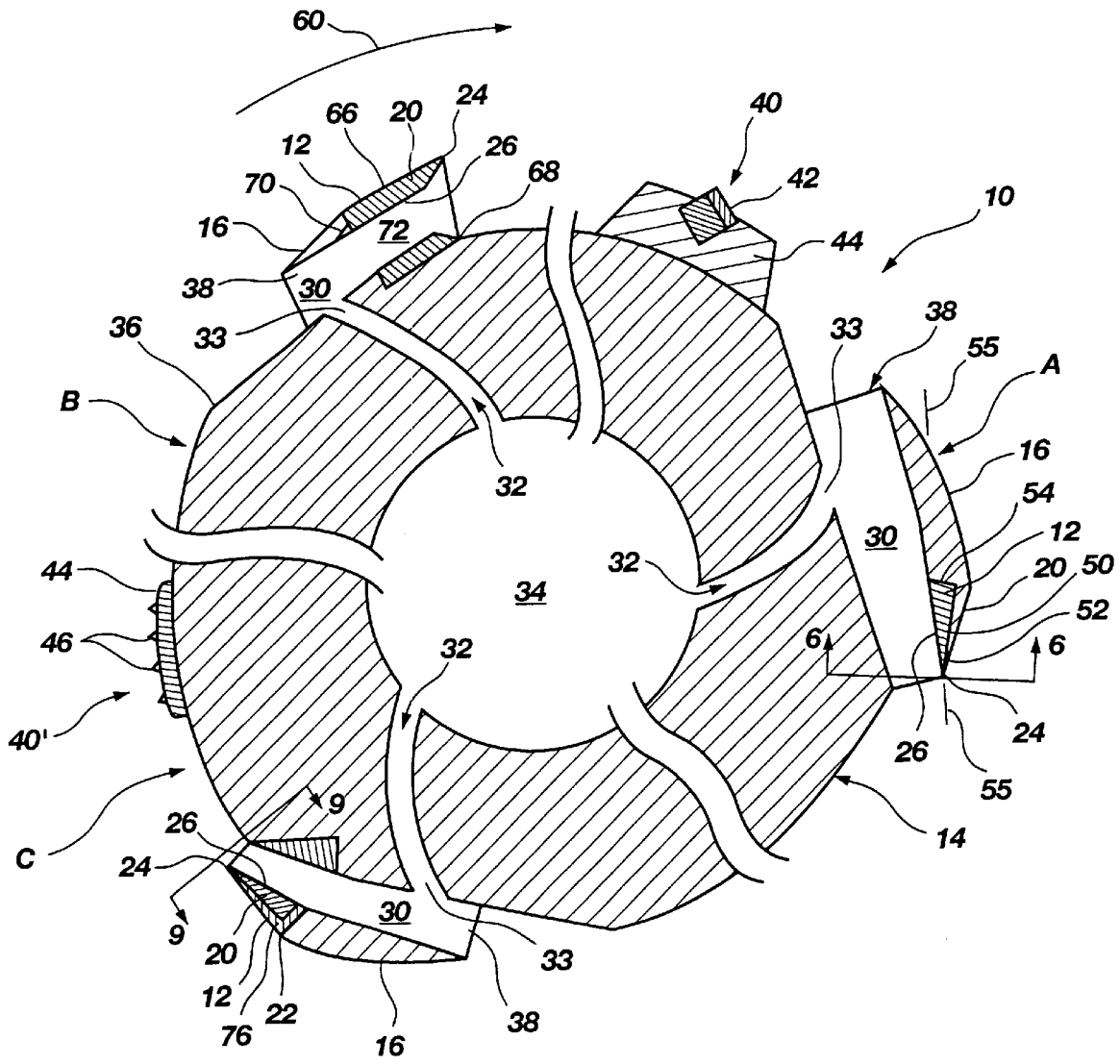
FIG. 5A is a view in lateral cross-section of a bit body which, for ease of illustration, comprises three different longitudinal sections of an exemplary bit body, denoted as portions A, B and C, where each portion bears a different embodiment of the cutting element of the present invention denoted as a first embodiment, third embodiment and fourth embodiment, respectively.

FIG. 5A illustrates a lateral section of a bit body 10 (i.e., taken at a plane perpendicular to the longitudinal axis of the bit body 10) which, for ease of illustration, comprises three separate longitudinal sections of a rotary drill bit 10 combined as if comprising an entire drill bit 10. Each of the different sections A, B and C of the drill bit 10 bear a different embodiment of cutting element 12 of the present invention, as described herein.

Although the lateral cross-section of FIG. 5A only illustrates one cutting element 12 per section A, B and C of the bit body 10, in practice, the bit body 10 will be formed with a plurality of such cutting elements 12 positioned along the periphery (i.e., gage) and/or crown of the bit body 10 as shown, for example, in FIGS. 3 and 4.

Cutting element 12 of the present invention comprises a superabrasive cutting member 20 which may be formed directly to bit body 10, as illustrated in sections A and B of FIG. 5A, or cutting element 12 may further comprise a substrate 22 (also referred to as a stud or backing) to which the superabrasive cutting member 20 is first attached, such as by an HTHP or CVD process, prior to attachment of cutting element 12 to the bit body 10, as illustrated in section C of FIG. 5A. Referring, for example, to the cutting element 12 illustrated in section A of FIG. 5A, cutting element 12 further comprises a leading edge 24, positioned to contact and engage an earth formation, and an arcuate or curved, generally frusto-conical or frustram-shaped surface, or scoop-like surface 26 which is positioned rearward of leading edge 24 and oriented and aligned to guide drill fluid laden with formation chips away from leading edge 24 of cutting element 12 as leading edge 24 engages the formation being drilled. Hence, cutting element 12 is preferably positioned and appropriately oriented on bit body 10 in conjunction with an associated passageway through which formation chips may be urged for removal by way of drilling fluid carrying the formation chips away from cutting element 12 and ultimately away from bit body 10 and the formation. Examples of other suitable bit bodies to which the cutting elements 12 of the present invention may be incorporated are disclosed in U.S. Pat. Nos. 4,883,132 and 5,199,511.

Exemplary bit body 10, which is particularly suitable for use with cutting elements 12 of the present invention as illustrated in FIG. 5A, is preferably provided with a cutting element passageway 30 associated with and generally coaxially aligned with cutting element 12 and is preferably configured and positioned to direct formation chips past scoop-like surface 26 of cutting element 12, to the exterior of bit body 10 where formation chips are flushed generally away from the formation being drilled. Bit body 10 is also preferably constructed with fluid passages 32, extending from a central plenum 34 of the bit body 10, through which drilling fluid is pumped through the drill string (not shown), and introduced to passageway 30 associated with each cutting element 12. Drilling fluid being forced through each internal fluid passage 32 at elevated pressures exits passage 32 at discharge port 33 which causes formation chips entering passageway 30 to be educted through and out of passageways 30 in accordance with dynamic fluid flow principles.

With respect to passageways 30 provided in and/or on bit body 10, such passageways may be substantially open, as illustrated in section B of FIG. 5A, meaning a substantial portion or length of the passageway 30 is open to the outer surface 36 of bit body 10, or passageway 30 may be closed, as illustrated in sections A and C of FIG. 5A where a substantial portion of the length of the passageway 30 is positioned within the bit body 10. While it is preferred that passageways 30 be structured with a minimized length to prevent formation chips from lodging therein, passageways 30 are also structured to expand or diverge in diameter or cross-section from a position near the leading edge 24 of the cutting element 12 to exit opening 38 of passageway 30 to further prevent formation chips from lodging within passageway 30.

Figure 5B:
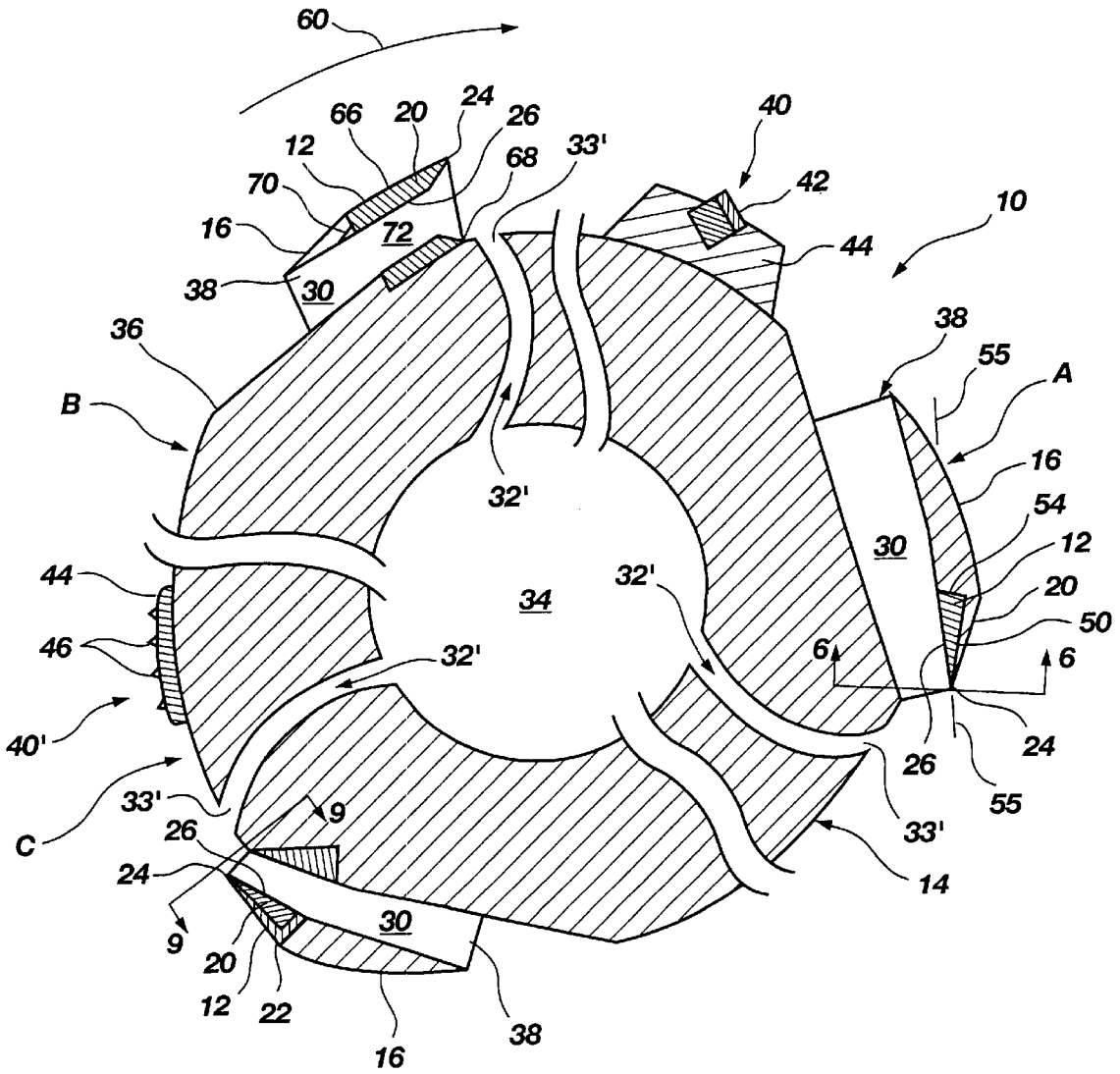
FIG. 5B is a view in lateral cross-section of the exemplary bit body shown in FIG. 5A wherein the exemplary bit body is provided with alternative fluid passages that have fluid discharge ports exterior to the cutting elements as contrasted with fluid discharge ports being positioned within the interior of the cutting elements and associated passageways as shown in FIG. 5A.

Although each fluid passage 32 shown in FIG. 5A is depicted as terminating at respective discharge ports 33 which are positioned to direct fluid into passageway 30 behind cutting element 12, or stated differently, within the interior of passageway 30, such fluid channels and discharge ports can be located exterior to passageway 30 as shown in FIG. 5B so as to be located aft of cutting element 12 with respect to the intended direction of bit rotation, 60.

As shown in FIG. 5B, which is essentially identical to FIG. 5A with the exception that alternative fluid passages 32' are routed from plenum 34 of bit body 10 so as to allow discharge ports 33' to be positioned ahead of or forward of cutting element 12 so that pressurized drilling fluid being discharged through discharge port 33' will be engulfed by passageway 30 as the fluid travels into the hollow region encircled by scoop-like surface 26 and on through cutting element 12 as drill bit 10 rotates and cutting elements 12 engage and cut formations of earth. Thus, alternative discharge ports 33' are regarded as being positioned exterior of cutting element 12 and/or passageway 30.

Figure 5C:
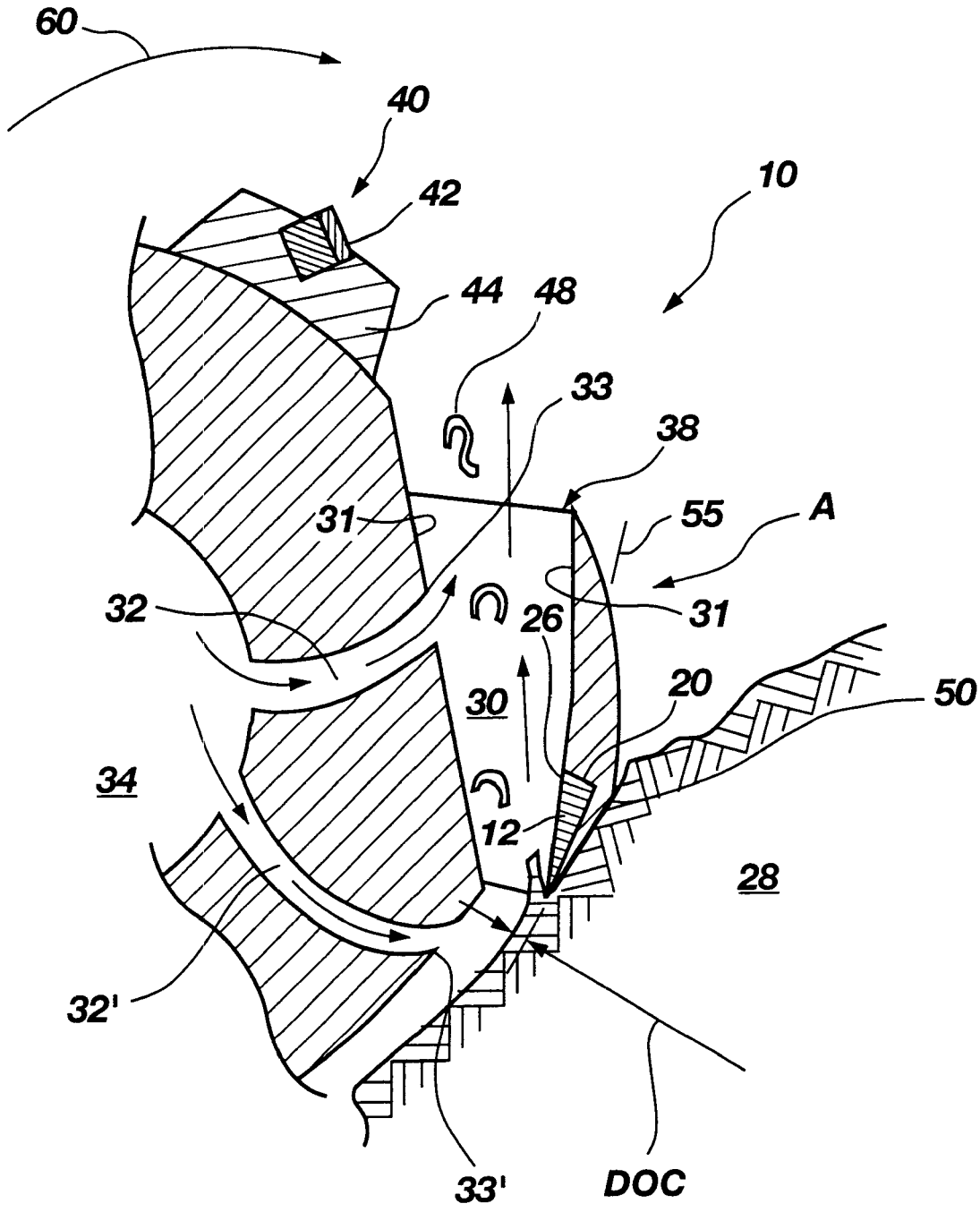
FIG. 5C is an isolated view of portion A of the bit body as shown in FIGS. 5A and 5B, with portion A thereof being provided with both types of fluid discharge ports and depicting the flow of the fluid carrying away formation cuttings, and further depicting the depth-of-cut (DOC) of the depicted exemplary cutting element.

A yet further alternative is to provide a cutting element 12 with both types of discharge ports. That is, a given passageway 30 associated with a given cutting element 12 can be provided with at least one interior discharge port 33 and at least one exterior discharge port 33' as shown in FIG. 5C. As illustrated in FIG. 5C, which depicts in isolation region A of bit body 10 as illustrated in FIGS. 5A and 5B, passageway 30 is provided with both a discharge port 33 located and positioned to discharge drilling fluid into passageway 30 behind or aft cutting element 12 and a discharge port 33' located and positioned to discharge drilling fluid ahead or forward of cutting element 12 with respect to the direction of rotation of bit body 10 shown by arrow 60. Thus, it can be appreciated that formation cuttings, designated as 48, are efficiently carried away from leading edge 24 of cutting element 12 as the drilling fluid travels between scoop-like surface 26 and the wall 31 of passageway 30 as cutting element 12 engages formation 28. Moreover, and if desired, discharge ports 33,33' can be provided with fluid jets or nozzles to optimize the flow of drilling fluid in proximity of and through cutting element 12 and, if provided, preferred passageway 30.

Additionally shown in FIG. 5C is a distance designated as DOC which indicates the depth-of-cut in which cutting element 12 engages and removes formation material which in turn results in the generation of formation chips or cuttings 48. By properly controlling the depth-of-cut of each cutting element 12, which need not be the same but can vary from cutting element to cutting element on a bit body, a high quality borehole will result and unwanted cutter failure will be avoided. Furthermore, it is important that the depth-of-cut of each cutting element of a bit be selected so as not to result in excessive drill string torques being required to turn bit body 10. That is, if the depth-of-cuts of each of the preselected number of cutting elements provided on a drill bit is such that, in cumulation, too much formation material is being removed by the cutting elements, the rotation of the bit body may stall causing damage to the drill string, the motor turning the drill bit, and/or other equipment such as downhole motors which may be used in conducting drilling operations.

However, it should be understood that cutting element 12 may be attached to other drill bits which, for example, are not structured with fluid channels such as those illustrated in FIGS. 4–5C, but which deliver fluid from the plenum of the drill bit to outside the drill bit body in a conventional manner, such as by ports provided on the crown of the drill bit, thereby providing fluid delivered to the outside of the drill bit body which, upon exiting the drill bit, will tend to travel generally upward toward the surface between the formation being drilled and face of the drill bit.

Bit body 10 is preferably provided with at least one depth-limiting structure oriented to limit the depth to which cutting elements 12 may engage the formation, thereby further reducing the potential for producing unduly large formation chips which are difficult to direct through the passageways of bit body 10. Depth-of-cut (DOC) limiting structures are well-known in the art, but one exemplary depth-of-cut limiting structure 40 as shown in FIG. 3 and in portion A of bit body 10 illustrated in FIGS. 5A–5C, comprise a plurality of conventionally configured cutting elements 42 which are preferably oriented with a substantial negative back rake angle relative to the formation. Thus, conventional cutting elements 42 are usually positioned on a projecting ridge or pad 44 and extend generally radially outward from bit body 10, however, cutting elements 42 may be disposed on pad 44 so as to be flush therewith if desired. Another exemplary depth-of-cut limiting structure 40' that is particularly suitable for use with the present invention is illustrated in FIG. 3 and portion C of FIG. 5A where a projecting ridge 44 or gage pad is provided with wear-resistant elements 46 or is coated with a wear-resistant material. Wear-resistant elements 46 can comprise materials such as diamonds, tungsten carbide inserts, or any other suitably hard wear-resistant materials. A large variety of other depth-of-cut limiting structures other than those specifically described herein may be employed. Additionally, the depth-of-cut limiting structures may be positioned in front of the cutting element, as shown in section C of FIG. 5A, or may be positioned behind the cutting element, as shown in section A of FIG. 5A. Furthermore DOC structures can be positioned closer or further away from representative cutting elements 12 than as illustrated.

Although cutting element 12 embodying the present invention has been described in a general manner above, specific exemplary embodiments of the present invention will now be discussed in detail.

Figure 6:
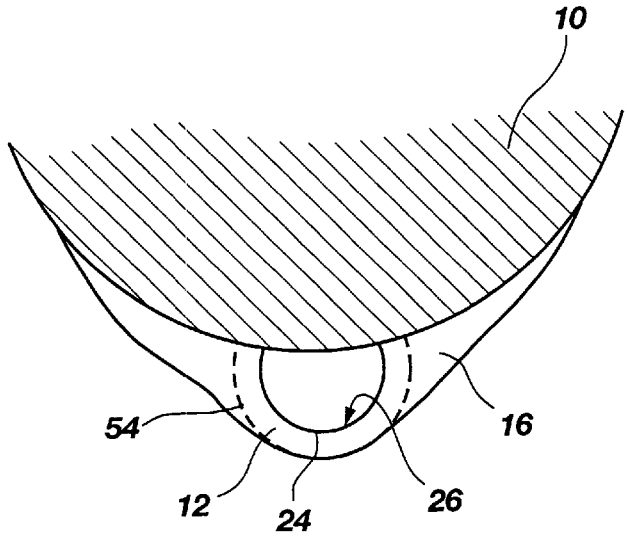
FIG. 6 is a partial cross-sectional view of a first embodiment of the cutting element of the present invention shown in portion A of FIG. 5A and 5B, taken at line 6—6, which illustrates a cutting element formed directly in the bit body.
Figure 7:
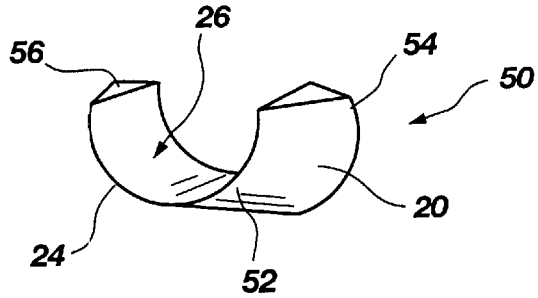
FIG. 7 is a perspective view of the superabrasive cutting member illustrated in FIG. 6.

In the first embodiment of cutting element 50 of the invention shown in portion A of FIG. 5A and in FIGS. 6 and 7, it can be seen that cutting element 50 comprises a three-dimensional superabrasive cutting member 20 which is formed directly to bit body 10. Cutting element 50 is formed as approximately one longitudinal half of a truncated cone where the smaller, truncated first end 52 of cutting member 20 forms a radiused leading edge 24 and the wider, second radiused end 54 of the truncated cone is positioned away from leading edge 24. A scoop-like surface 26 extends between narrower leading edge 24 and diverges toward wider second end 54 of cutting member 20. Scoop-like surface 26 is referred to as being three-dimensional due to having, as shown in this embodiment, a substantially curved or arcuate profile that is positioned so as to be located generally, allowing for the conical, diverging geometry, parallel to a longitudinal axis 55 (FIG. 5A) of cutting element 50. As also illustrated in FIGS. 5A and 7, cutting member 20 may have a selected varied thickness dimension such that second end 54 of the truncated cone is greater in thickness than truncated first end 52, thereby providing a wedge-shape 56 in longitudinal cross-section of cutting element 50. Alternatively, however, the thickness of cutting member 20 may be more substantially constant from a point near leading edge 24 to second end 54 of cutting member 20. It is particularly notable that the configuration of cutting element 12 illustrated in FIG. 7 is particularly advantageous in that it places the cutting member in compression when positioned in bit body 10 so as to have a positive rake angle with respect to the formation to be engaged by leading edge 24.

Figure 8:
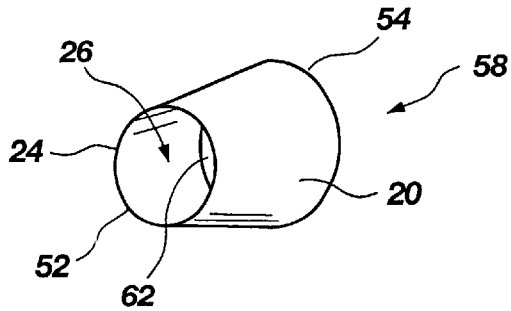
FIG. 8 is a perspective view of a second embodiment of a superabrasive cutting member which may be formed directly in the bit body.

In a second embodiment of the invention illustrated in FIG. 8, cutting element 58 may again be comprised of a superabrasive cutting member 20 which is disposed directly onto bit body 10, but cutting element 58 is configured as a full cone being truncated at a small first end 52 defining leading edge 24 and a wider, second end 54 positioned away from leading edge 24. Three dimensional scoop-like surface 26 extending between leading edge 24 and diverging toward second end 54 is substantially circular in lateral cross-section and includes an opening 62 which is preferably in generally coaxial communication with an associated passageway 30 through which formation chips are directed during drilling.

A third embodiment of the invention is illustrated in portion B of FIG. 5A where cutting element 66 is comprised of a superabrasive cutting member 20 disposed directly to bit body 10. Cutting member 20 is formed as a hollow cylinder having a first end 68 defining leading edge 24 of cutting element 66 and an opposing second end 70 positioned away from leading edge 24. The embodiment illustrated in section B of FIG. 5A demonstrates that cutting element 12 may be configured in any suitable geometry having an appropriate leading edge 24 positioned to shear the formation. In the embodiment illustrated, first end 68 may be formed with a thickness dimension which is less than the thickness dimension at a portion spaced away from first end 68 to provide a chisel-like leading edge 24. Opening 72 formed through cutting member 20 preferably has an internal diameter which is greater near opposing second end 70 than near first end 68 to facilitate movement of formation chips therethrough.

Figure 9:
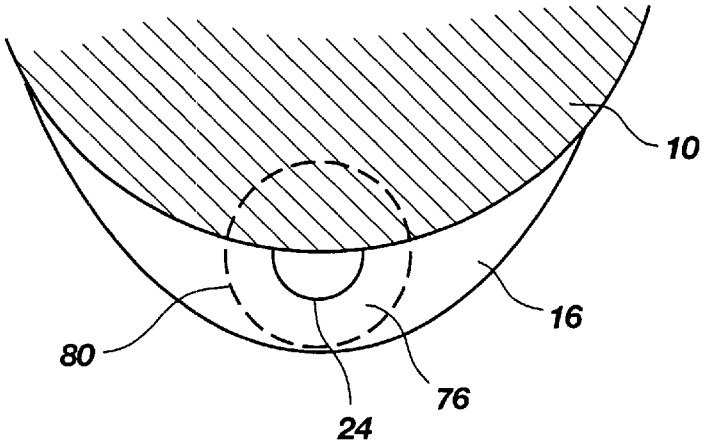
FIG. 9 is a view in partial cross-section of a fourth embodiment of the cutting element of the present invention shown in section C of FIG. 5A and 5B, taken at line 9—9, illustrating a cutting element which includes a substrate.
Figure 10:
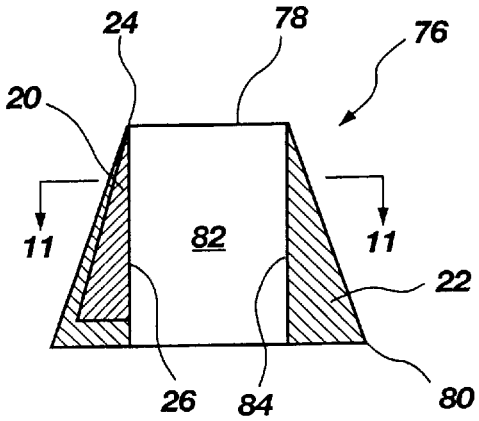
FIG. 10 is an enlarged view in longitudinal cross-section of the cutting element illustrated in section C of FIGS. 5A and 5B in FIG. 9.
Figure 11:
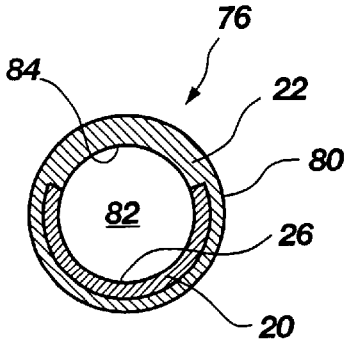
FIG. 11 is a view in lateral cross-section of the cutting element shown in FIG. 10, taken at line 11—11.

Cutting element 12 of the present invention may also be formed as a superabrasive cutting member 20 formed to a substrate .22 or backing which is, in turn, attached by known methods to the bit body 10. An example of such a cutting element 76 is illustrated in FIGS. 9–11. In this embodiment, superabrasive cutting member 20 is configured as a longitudinal section of a truncated cone as illustrated in FIG. 11. The superabrasive cutting member 20 is then formed to a substrate 22 by known techniques. As best illustrated in FIG. 10, substrate 22 may be formed as a hollow truncated cone having a first end 78 of smaller circumference than a second end 80. The leading edge 24 of the superabrasive cutting member 20 is oriented toward the first end 78 of the substrate 22 to position the leading edge toward a formation for cutting.

Substrate 22 is formed with a central opening 82 which extends from first end 78 to second end 80 of substrate 22. Substrate 22 may be preferably configured so that opening 82 has a larger internal diameter near second end 80 than the internal diameter of opening 82 near first end 78 to facilitate movement of formation chips through the cutting element and preferred passageway 30. Alternatively, the internal diameter of opening 82 may be substantially consistent along the entire length of opening 82 from first end 78 to second end 80 of substrate 22. Opening 82 through substrate 22 provides an inner surface 84 which, when superabrasive cutting member 20 is disposed on substrate 22, is flush with scoop-like surface 26 of superabrasive cutting member 20, as illustrated more fully in FIGS. 10 and 11. The substantially arcuate profile of scoop-like surface 26 can especially be seen in the cross-sectional view of FIG. 11.

FIG. 10 illustrates but one possible configuration for a cutting element of the present invention which is comprised of a superabrasive cutting member 20 and a substrate 22. FIGS. 12 through 18 illustrate additional exemplary ways of configuring cutting member 20 in a manner which enhances the compressive stresses in cutting element 12 during drilling. Each of the embodiments illustrated in FIGS. 12 through 18 comprise cutting member 20 disposed on substrate 22 which is configured as a truncated cone. However, substrate 22 of cutting element 12 of the present invention is not intended to be limited to a truncated cone. A truncated cone is one possible way to configure a cutting element 12 of the present invention so that leading edge 24 is oriented toward a formation, but many other shapes, configurations or geometries are equally suitable. Further, as suggested by the phantom lines in FIG. 12, it is understandable that initially configuring cutting element 12 as a hollow cylinder 86 may facilitate its production by known techniques (i.e., HThP or CVD) and excess material represented by phantom lines 88 may then be removed, such as by electro-discharge machining or grinding, to provide the preferred generally conical shape of substrate 22.

Figure 12:
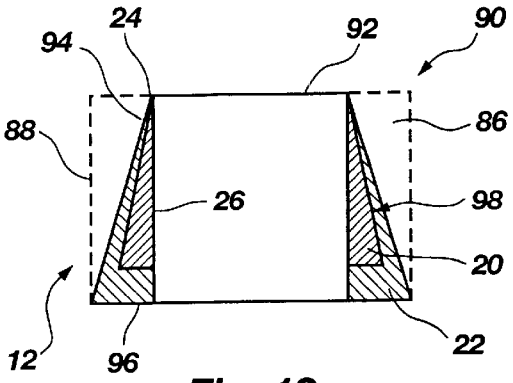
FIG. 12 is a view in longitudinal cross-section of a fifth embodiment of the cutting element of the present invention.

A fifth embodiment of cutting element 12 is depicted as cutting element 90 illustrated in FIG. 12 and is comprised of a superabrasive cutting member 20 which is configured as a fully circular truncated cone as illustrated in FIG. 8. Truncated end 92 of superabrasive cutting member 20, therefore, provides an extended leading edge 24 which encircles first end 94 of substrate 22. The material (e.g., tungsten carbide) of substrate 22 extends from second end 96 of substrate 22 to first end 94 of substrate 22 and encircles an outer surface 98 of the cutting member 20.

Figure 13:
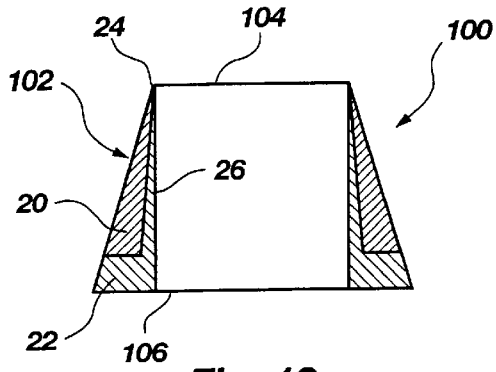
FIG. 13 is a view in longitudinal cross-section of a sixth embodiment of the cutting element of the present invention.

In a sixth embodiment shown in FIG. 13, cutting element 100 is again comprised of a superabrasive cutting member 20 disposed on a substrate 22, but superabrasive member 20 is positioned toward outer surface 102 of cutting element 100 and the material of substrate 22 extends from first end 104 to second end 106 of substrate 22 within superabrasive cutting member 20. Thus, in this embodiment, scoop-like surface 26 of cutting element 100 is formed by substrate 22 rather than by superabrasive cutting member 20 as previously illustrated and described. In the embodiment illustrated in FIG. 13, more superabrasive material of cutting member 20 is exposed to the formation for enhanced cutting.

Figure 14:
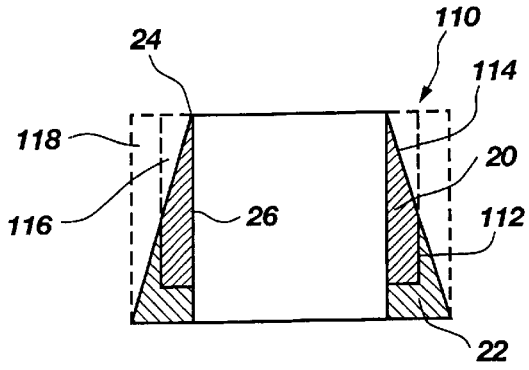
FIG. 14 is a view in longitudinal cross-section of a seventh embodiment of the cutting element of the present invention.

In a seventh embodiment designated as cutting element 110 illustrated in FIG. 14, cutting member 20 is configured as a substantially truncated cone with lower periphery 112 thereof defining a cylinder. In this embodiment, a greater portion of superabrasive cutting member 20 is exposed to the formation and provides an outer surface 114 of superabrasive material. By way of example only, the embodiment illustrated in FIG. 14 may be constructed by the combination of a cylinder 116 of superabrasive material formed within an outer cylinder 118 made of, for example, tungsten carbide material which is then machined to remove those portions suggested by the phantom lines to render the configuration of cutting element 110 shown.

Figure 15:
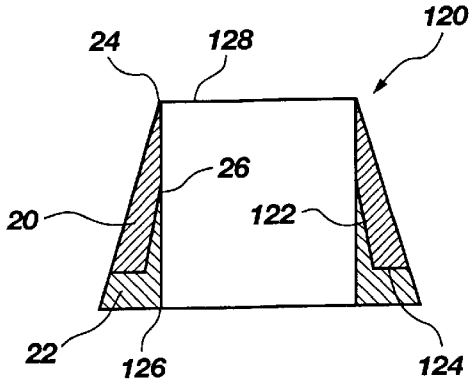
FIG. 15 is a view in longitudinal cross-section of an eighth embodiment of the cutting element of the present invention.

FIG. 15 further illustrates an eighth embodiment designated as cutting element 120 where superabrasive cutting member 20 is substantially configured as a truncated cone as previously illustrated and described. However, inner surface 122 of cutting member 20 is modified to provide a greater inner diameter near base 124 of cutting member 20 such that the material of substrate 22, about which superabrasive cutting member 20 is positioned, extends from second end 126 of cutting element 120 to only a portion of the distance to first end 128 of cutting element 120. Scoop-like surface 26 is, therefore, partially comprised of superabrasive material and partially comprised of substrate material to further enhance the compressive stresses in the cutting element 120.

Figure 16:
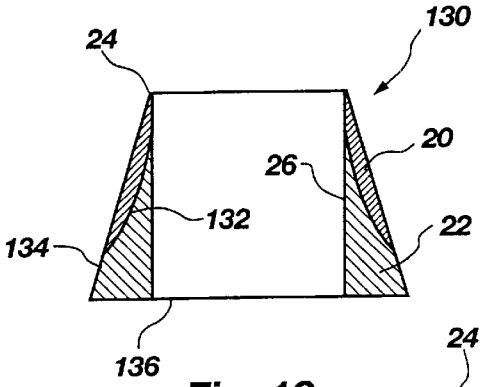
FIG. 16 is a view in longitudinal cross-section of a ninth embodiment of the cutting element of the present invention.

FIG. 16 illustrates a ninth embodiment of the present invention designated as cutting element 130 wherein superabrasive cutting member 20 is configured with what may be generally considered a truncated conical shape. However, inner facing surface 132 of cutting member 20, which is positioned against the material of substrate 22, is curved in a direction extending from near the leading edge 24 of cutting element 130 to exterior surface 134 of cutting element 130 near end 136 of cutting element 130 positioned away from leading edge 24. In this embodiment, a greater portion of superabrasive material is positioned toward exterior surface 134 of cutting element 130 and scoop-like surface 26 is more proportionately comprised of substrate material.

Figure 17:
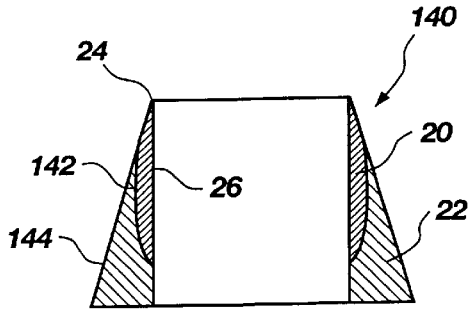
FIG. 17 is a view in longitudinal cross section of a tenth embodiment of the cutting element of the present invention.
Figure 18:
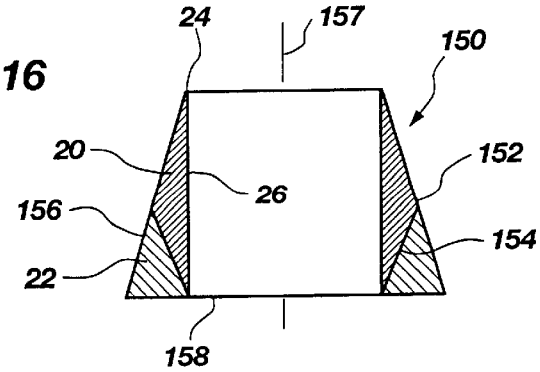
FIG. 18 is a view in longitudinal cross section of an eleventh embodiment of the cutting element of the present invention.

In a tenth embodiment of the present invention designated as cutting element 140 as illustrated in FIG. 17, superabrasive cutting member 20 may again be configured with a curved surface 142 positioned against the material of substrate 22, but in this embodiment, curved surface 142 of cutting member 20 is oriented outwardly toward exterior surface 144 of cutting element 140 and less superabrasive material is positioned on the exterior of cutting element 140. Conversely, however, a proportionately larger area of scoop-like surface 26 of cutting element 140 is comprised of superabrasive material.

Figure 19:
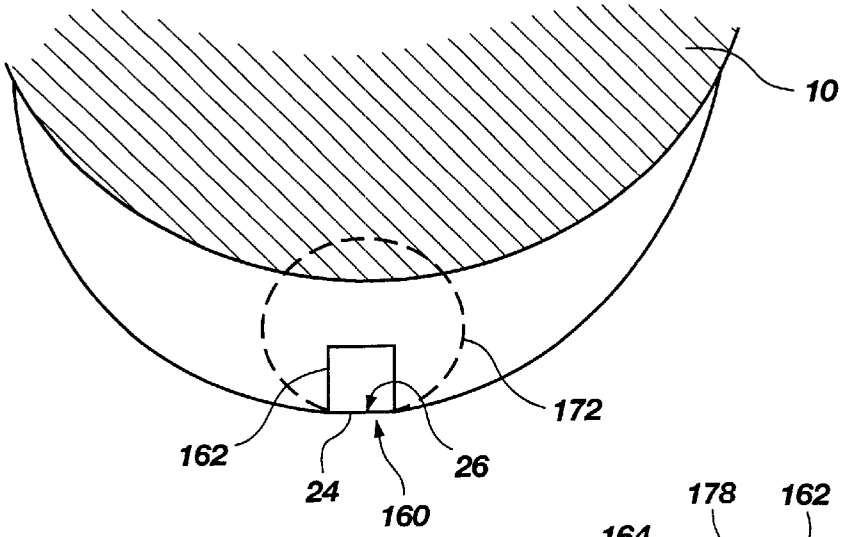
FIG. 19 is a view in partial cross section of a bit body illustrating a twelfth embodiment of the cutting element of the present invention having a linear leading edge.

In an eleventh embodiment, cutting element 150 is illustrated in FIG. 19 and superabrasive member 20 is generally configured in the shape of a truncated cone. Bottom portion 152 of cutting member 20 is inwardly angled to provide a surface 154 which extends from exterior surface 156 of cutting element 150 toward central axis 157 of cutting element 150 near second end 158 thereof which is positioned away from leading edge 24. Thus, the material of substrate 22 surrounds surface 154 of cutting member 20 and extends to end 158 of cutting element 150.

Figure 20:
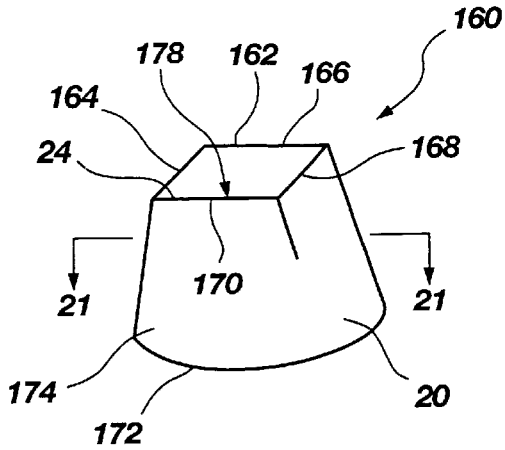
FIG. 20 is a perspective view of the cutting element illustrated in FIG. 19.
Figure 21:
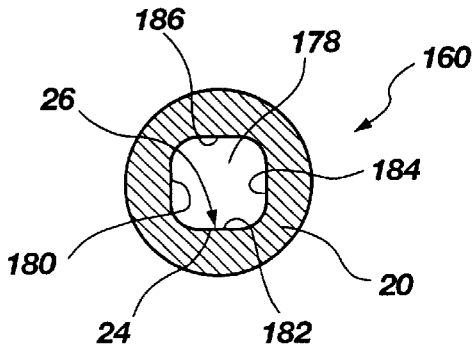
FIG. 21 is a view in lateral cross-section of the cutting element illustrated in FIG. 20, taken at line 21—21.

FIGS. 19, 20 and 21 illustrate a twelfth embodiment of the present invention designated as cutting element 160 where cutting member 20 is generally configured as a truncated pyramid and where first end 162 of cutting element 160 defines a leading edge 24 which is linear or straight, rather than curved as previously illustrated and described. As with the other embodiments, linear leading edge 24 of cutting element 160 has the potential to enhance the compressive stresses in cutting element 160 during drilling and may lessen cutting loads. Cutting element 160 is illustrated in FIG. 19 as being positioned with respect to drill bit body 10 to demonstrate the general orientation of leading edge 24 relative to the bit body and the formation. Cutting element 160 is also illustrated as being disposed directly on bit body 10 (i.e., without an associated substrate), but superabrasive cutting member 20 may be equally adaptable to being constructed with a substrate 22 as previously described with respect to the embodiments illustrated in FIGS. 12–18.

FIG. 20 more specifically illustrates that first end 162 of cutting member 20 is generally configured to have four sides 164, 166, 168, 170 as a result of being formed in the shape of a truncated pyramid. Second end 172 of cutting member 20 may retain the conventional four sides of a pyramid or, as illustrated, may be modified to provide a generally circular outer circumference 174. A lateral cross section of cutting member 20, as shown in FIG. 21, reveals, however, that the four-sided configuration of a generally pyramidal shape may be maintained with respect to opening 178 formed through cutting member 20, which extends from first end 162 to second end 172 of cutting member 20, and scoop-like surface 26. Such an embodiment preferably generally comprises portions 180, 182, 184, 186 which are planar in lateral cross-section but which provide a scoop-like surface 26 which is arcuate formed into a three-dimensional shape to facilitate movement of formation chips through cutting member 20 and, in effect, provides a passageway 30 or a generally coaxial extension of a passageway 30 as described earlier. Alternatively, opening 178 may be configured as having a circular profile.

Figure 22:
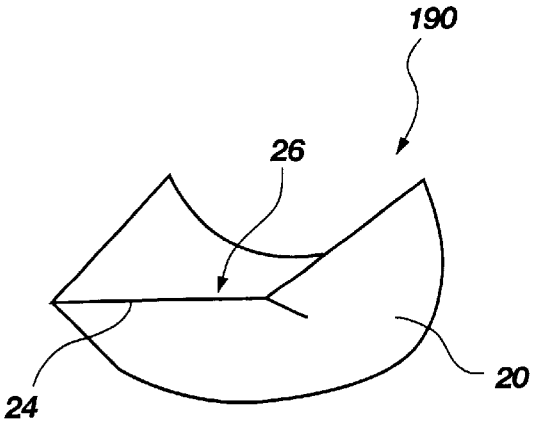
FIG. 22 is a perspective view of a thirteenth embodiment of the cutting element of the present invention.

FIG. 22 illustrates a thirteenth embodiment of the invention designated as cutting element 190 in which cutting member 20 is configured as a longitudinal section (i.e., one-half) of a truncated pyramid as previously shown in FIG. 20. In the embodiment of FIG. 22, leading edge 24 is linear or straight and the three-dimensional scoop-like surface 26 is configured to move formation chips away from the leading edge 24 of cutting element 190 as described earlier. Cutting member 20 shown in FIG. 22 may be disposed directly to a drill bit body or may be disposed on a substrate which is then attached to a drill bit body as previously described and illustrated.

Figure 1:
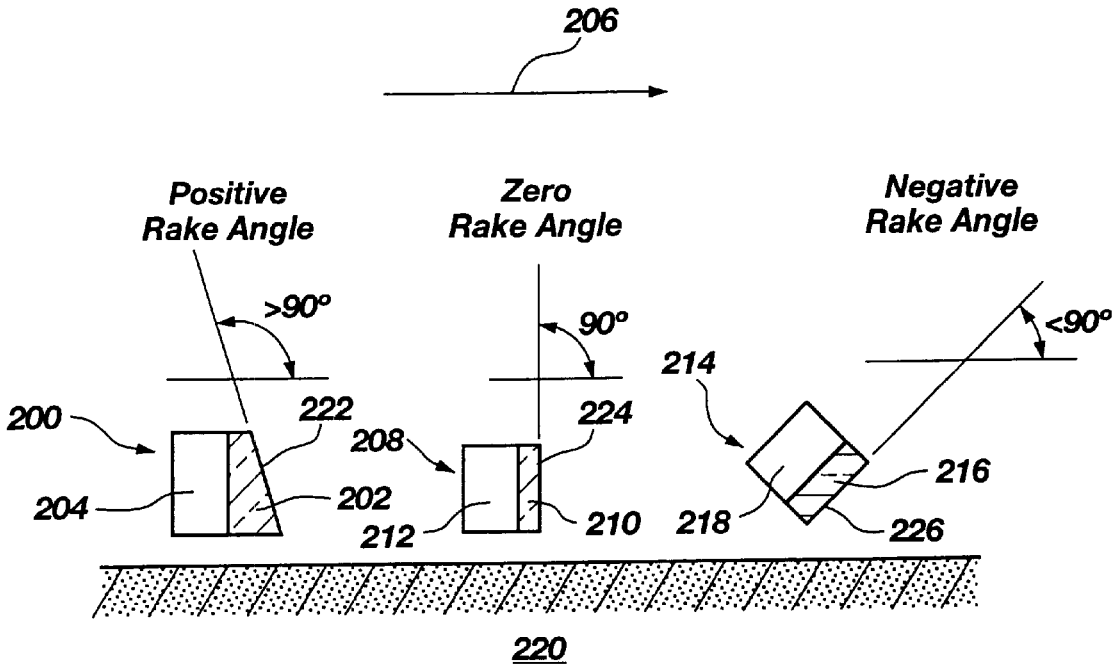
Fig. 1 (PRIOR ART)
FIG. 1 is an illustration of three representative prior art PDC cutters having three different rake angles with respect to the earth formation to be respectively engaged by the cutters.
Figure 2A:
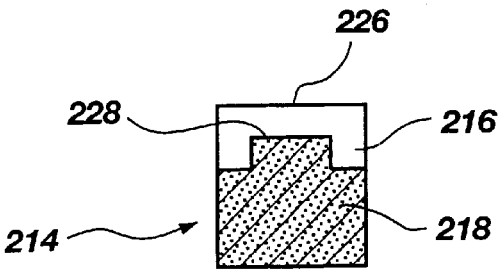
Fig. 2A (PRIOR ART)
FIG. 2A is a cross-sectional view of one of the representative cutters of FIG. 1.
Figure 2B:
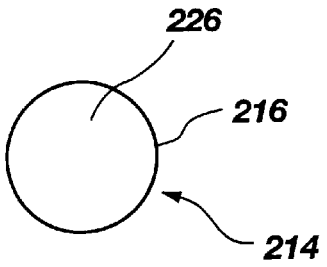
Fig. 2B (PRIOR ART)
FIG. 2B is a top view of the representative cutter shown in FIG. 2A.

Thus, it can now be appreciated that cutting elements in accordance with the present invention, including cutting element 12 and exemplary variations thereof as disclosed and suggested herein, are preferably provided with a scoop-like surface 26 that is arcuate or curved, extending in three dimensions so as to partially or fully encircle or encompass a hollow region generally within cutting element 12, such as is present in a surgical curette which is characterized as having a ring-shaped cutting surface. Therefore, cutting elements being configured in three dimensions which embody the present invention are markedly different from prior art cutting elements comprising cutting surfaces that typically extend in only two dimensions, such as cutting element surface 226 of representative cutter 214 shown in FIGS. 2A and 2B. Therefore, cutting elements of the present invention will preferably comprise in some manner a partially or fully convoluted or curved cutting surface that serves to at least partially encircle or bound an open-ended volumetric region or cavity therein which preferably forms a generally coaxial portion or extension of passageway 30, or which is otherwise at least in fluid communication with passageway 30.

Cutting elements of the present invention are preferably configured to place the superabrasive cutting member in compression during drilling to lessen or avoid failure of the cutting element due to stressful loading conditions. The configuration of the cutting elements also facilitate placement of the superabrasive cutting member at a high positive rake angle to promote efficient operation of the cutting element during drilling. The particular configuration of the superabrasive cutting member and/or the substrate to which the superabrasive cutting member is formed is dictated by the conditions and parameters of the formation to be drilled. Hence, reference herein to specific details of the illustrated embodiments is by way of example and not by way of limitation. It will be apparent to those skilled in the art that many additions, deletions and modifications to the illustrated embodiments of the present invention may be made without departing from the spirit and scope of the present invention as set forth by the following claims.

What is claimed is:

1. A cutting element for use in a rotary drill bit of the type used for drilling subterranean formations, comprising:

a cutting member comprising superabrasive material, the cutting member having a first end and a second end spaced from the first end, the first end comprising a leading edge structured for engaging and cutting subterranean formations; and a scoop surface extending from the leading edge of the first end and at least partially defining an open-ended cavity passing through the cutting element, the scoop surface configured to direct formation cuttings through the open-ended cavity.

2. The cutting element of claim 1, wherein the leading edge is substantially nonlinear.

3. The cutting element of claim 1, wherein the leading edge is substantially linear.

4. The cutting element of claim 1, wherein the cutting member is configured as a longitudinal section of a truncated pyramid.

5. The cutting element of claim 1, wherein the cutting member is configured as a longitudinal section of a truncated cone.

6. The cutting element of claim 1, wherein the cutting member is configured as a hollow cylinder having an inwardly beveled edge comprising the leading edge.

7. The cutting element of claim 1, wherein the cutting member is configured as a truncated cone.

8. The cutting element of claim 1, wherein the cutting member is configured as a truncated pyramid.

9. The cutting element of claim 1, wherein the second end of the cutting member has a thickness dimension greater than a thickness dimension of the leading edge.

10. The cutting element of claim 1, further comprising a substrate to which said cutting member is attached, said substrate having a first end oriented toward the leading edge of the cutting member and having a second end configured for attachment to a drill bit body.

11. The cutting element of claim 10, wherein the substrate is positioned substantially about an outer surface of the cutting member.

12. The cutting element of claim 10, wherein the substrate is positioned substantially interior to the cutting member.

13. The cutting element of claim 10, wherein the second end of the substrate has a thickness dimension greater than a thickness dimension of the first end of the substrate.

14. The cutting element of claim 10, wherein the substrate is configured as a truncated cone.

15. The cutting element of claim 10, wherein the substrate is configured as a truncated pyramid having at least four sides.

16. The cutting element of claim 1, wherein the open-ended cavity forms at least part of an open-ended passageway having a first open end at the leading edge and a second open end, the open ended passageway structured to expand from a first cross-sectional area at the first open end to a larger second cross-sectional area at the second open end.

17. A rotary drill bit for use in drilling subterranean formations comprising:

a bit body having an exterior surface configured for attachment of a plurality of cutting elements thereto, the bit body having at least one plenum for movement of fluid therethrough and a plurality of passageways for conveying formation cuttings therethrough;

a plurality of cutting elements positioned on the exterior surface of the bit body; and at least one of the plurality of cutting elements comprising:

a superabrasive cutting member having a first end and a second end spaced from the first end, the first end comprising a leading edge positioned and structured for engaging and cutting subterranean formations at a positive rake angle; and a scoop surface extending from the leading edge of the first end and at least partially defining an open-ended cavity passing through the at least one cutting element of the plurality of cutting elements, the scoop surface configured to direct said formation cuttings through the open-ended cavity passing through the at least one cutting element of the plurality of cutting elements.

18. The rotary drill bit of claim 17, further comprising: said drill bit having at least one passageway of the plurality of passageways being positioned rearward of the at least one cutting element of the plurality of cutting elements and being generally coaxially aligned therewith.

19. The rotary drill bit of claim 18, wherein the at least one passageway of the plurality of passageways and the open-ended cavity passing through the at least one cutting element of the plurality of cutting elements are-essentially co-extensive.

20. The rotary drill bit of claim 19, wherein the at least one passageway of the plurality of passageways is an open-ended passageway having a first open end and a second open end, the open ended passageway structured to expand from a first cross-sectional area at the first open end to a larger second cross-sectional area at the second open end.

21. The rotary drill bit of claim 18, further comprising at least one fluid passage extending from the at least one plenum to the exterior surface of the bit body.

22. The rotary drill bit of claim 21, wherein the at least one fluid passage comprises at least one discharge port positioned in proximity to the at least one cutting element of the plurality of cutting elements.

23. The rotary drill bit of claim 22, wherein the at least one discharge port of the at least one fluid passage is positioned to discharge said fluid within the interior of the at least one passageway of the plurality of passageways aft of the at least one cutting element of the plurality of cutting elements.

24. The rotary drill bit of claim 22, wherein the at least one discharge port of the at least one fluid passage is positioned exterior of the at least one passageway of the plurality of passageways to discharge said fluid forward of the at least one cutting element of the plurality of cutting elements.

25. The rotary drill bit of claim 18, wherein the at least one passageway of the plurality of passageways is formed at least in part along the exterior surface of the bit body.

26. The rotary drill bit of claim 17, further comprising at least one structure positioned on the exterior surface of the bit body for limiting a depth-of-cut of the at least one cutting element of the plurality of cutting elements.

27. The rotary drill bit of claim 17, wherein at least some of the plurality of cutting elements further comprise a superabrasive cutting member attached to a substrate.

28. A rotary drill bit for use in drilling subterranean formations comprising:

a bit body having an exterior surface configured for receiving a plurality of cutting elements and having at least one plenum for movement of fluid therethrough;

the bit body having a plurality of passageways capable of passing formation cuttings therethrough;

a plurality of superabrasive cutting elements each positioned on said exterior surface of the bit body to engage a subterranean formation and positioned in alignment with an associated passageway of the plurality of passageways, each cutting element of the plurality of cutting elements being configured with a leading edge oriented to engage a subterranean formation at a positive rake angle, an arcuately shaped scoop surface positioned rearward of the leading edge, the scoop surface extending in three directions to at least partially encompass a volumetric region that is aligned with the associated passageway of the plurality of passageways; and a plurality of fluid ports in communication with the at least one plenum, at least some of the plurality of fluid ports respectively positioned proximate to at least some of the plurality of cutting elements to release pressurized fluid for urging formation cuttings through the volumetric region and the associated passageway of the plurality of passageways.

29. The rotary drill bit of claim 28, wherein the drill bit body comprises at least one depth-of-cut limiting structure.

30. The rotary drill bit of claim 28, wherein the at least some of the plurality of cutting elements are configured in a geometry of a truncated frustum.

31. The rotary drill bit of claim 28, wherein at least one of the plurality of passageways is an open-ended passageway having a first open end and a second open end, the open ended passageway structured to expand from a first cross-sectional area at the first open end to a lager second cross-sectional area at the second open end.

32. A method of drilling subterranean formation comprising:

providing a rotary drill bit carrying a plurality of cutting elements, each of the plurality of cutting elements having a leading edge positioned at a positive rake angle and a three-dimensional scoop surface extending from the leading edge and at least partially defining an open-ended volumetric cavity passing through the cutting element, the plurality of cutting elements being positioned on an exterior surface of a bit body and generally aligned with an associated passageway provided on the bit body to pass formation cuttings therethrough, the drill bit further being provided with a plenum;

positioning the rotary drill bit in a subterranean formation with said plurality of cutting elements oriented to engage the formation and to place the plurality of cutting elements in compression; and urging the drill bit to drill into the formation such that formation cuttings are conveyed away from the leading edge of each cutting element of the plurality of cutting elements, across said three-dimensional scoop surface and through the open-ended volumetric cavity, and are further conveyed through the passageway associated therewith.

33. The method according to claim 32, further comprising providing internal passages extending from the plenum to respective discharge ports positioned proximate the plurality of cutting elements and discharging pressurized fluid from the discharge ports to enhance the conveyance of formation cuttings away from the leading edge of each cutting element of the plurality of cutting elements, across the three-dimensional scoop surface and through the open-ended volumetric cavity, and through the passageway associated therewith.

34. The method according to claim 32, further comprising providing at least one structure positioned on said exterior surface of said bit body for limiting a depth-of-cut of at least one of the plurality of cutting elements.

35. The method according to claim 34, wherein providing at least one structure comprises at least one structure projecting radially from said exterior surface of the bit body carrying at least one of the group consisting of wear-resistant elements and generally cylindrically shaped cutting element on a radially outwardly facing portion of said at least one structure.

36. The method according to claim 32, further comprising forming the associated passageway as an open ended passageway structured to expand from a first cross-sectional area to a larger second cross-sectional area and conveying the formation cuttings in a direction from the first cross-sectional area to the larger second cross-sectional area.

* * * * *